United States Patent [19]

Evans

[11] 4,238,894

[45] Dec. 16, 1980

[54] ARTICLE OF FOOTWEAR WITH A BACKWARD EXTENSION TO THE SOLE

[76] Inventor: David P. Evans, 32 Gloucester Rd., Almondsbury, Bristol, BS12 4HA, England

[21] Appl. No.: 949,563

[22] Filed: Oct. 10, 1978

[51] Int. Cl.[3] ..... A43B 13/00

[52] U.S. Cl. ..... 36/25 R; 36/83; 128/581

[58] Field of Search ..... 36/25 R, 32 R, 83, 117, 36/129, 1, 136, 7.5, 7.6, 11.5, 138; 128/581, 583, 584

[56] References Cited

U.S. PATENT DOCUMENTS

| | | | |
|---|---|---|---|
| 2,656,957 | 10/1953 | Bloch | 36/7.5 X |
| 2,769,252 | 11/1956 | Monier | 128/581 |
| 3,283,423 | 11/1966 | Schovee | 36/138 |

FOREIGN PATENT DOCUMENTS

| | | | |
|---|---|---|---|
| 267362 | 12/1968 | Austria | 36/83 |
| 2023534 | 12/1971 | Fed. Rep. of Germany | 36/117 |
| 2654116 | 6/1978 | Fed. Rep. of Germany | 36/129 |

*Primary Examiner*—James Kee Chi

*Attorney, Agent, or Firm*—Larson, Taylor and Hinds

[57] ABSTRACT

An article of footwear is disclosed for enabling a sufferer or potential sufferer of postural low back pain to lean backwards. An integral portion of a ground - engaging sole of the article is a projection which extends backwards at least one inch behind the coronal plane containing the posterior aspect of the heel of the wearer.

2 Claims, 1 Drawing Figure

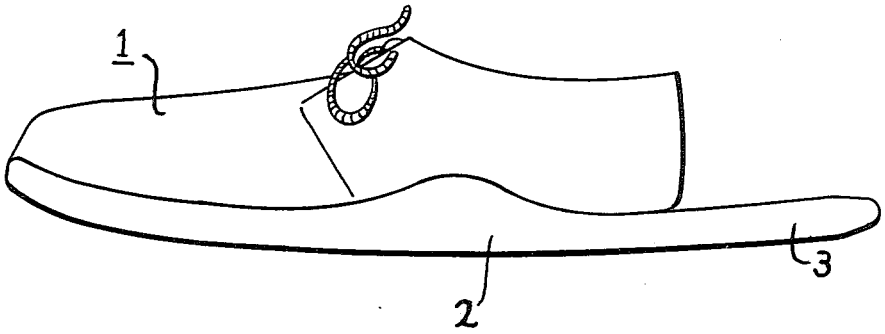
1
2
3

ARTICLE OF FOOTWEAR WITH A BACKWARD EXTENSION TO THE SOLE

FIELD OF THE INVENTION

This invention relates to articles of footwear. In this specification, an article of footwear is defined as a shoe or a sandal.

BACKGROUND OF THE INVENTION

As the human spine is constructed from many movable parts, and even during quiet standing it is subject to postural sway, it must be kept in position by active forces which counteract the pull of gravity and other forces acting on it. These active forces that the body can utilise to counteract the external forces are muscular and they adapt to the changing positions of the body by contracting reflexly. The "stays" or "guys" are represented by the muscles of the trunk; the abdominal muscles in front and to the sides; and the erectores spinae on the back. By electromyography, using skin electrodes pasted to the skin over the muscles, it is possible to detect whether or not underlying muscles are active.

Asmussen and Klausen (see Asmussen, E. and Klausen, K. (1962); Form and Function of the Erect Human Spine; Clin.Orthop., 25, p 55) showed that when electromyograms are registered simultaneously from the abdominal muscles (in this case the rectus abdominis) and from their antagonists, the lumbar portion of the erectores spinae, the two sets alternate in being active when voluntary slight movements backwards and forwards are performed in the hip joints. When standing quietly, only one set of muscles is active while the antagonists are silent electrically. This seems to justify the conclusion that the erect position of the spine is maintained principally by only one set of muscles acting as antagonists to the force of gravity. Asmussen and Klausen confirmed this finding by electromyographic studies involving about 50 young men and women. Further, it was found that in the majority of cases (i.e., 36 out of 46 cases, or 75%) it was the muscles of the back that counteract gravity. This percentage corresponded entirely to the results obtained from the analysis of anthropometric data from 201 boys.

In studies of the back muscles in 150 men, Floyd and Silver (see Floyd, W. F. and Silver, P. H. S. (1955); The Function of the Erectores Spinae Muscles in Certain Movements and Postures in Man; J. Physiol., 129, p 184) found slight or no activity when the subjects wore shoes and stood with the heels close together in a spontaneous upright position, looking to the front, with arms hanging loosely and comfortably at the sides. The electrodes were placed over the most prominent parts of the thoraco-lumbar and lumbar erectores spinae muscles. A movement forwards of the head evoked activity in those muscles showing no activity, and slight backwards movements of the hands, shoulders and head or swaying backwards at the ankle joints reduced or abolished activity which was present.

In further electromyographic studies, Joseph (see Joseph, J. (1960); Man's Posture—Electromyographic Studies; Charles C. Thomas, Springfield, Ill. U.S.A.) reported:

1. In the standing at ease position the recordings from the gluteal muscles showed no detectable activity. When subjects contracted their abdominal muscles voluntarily, there were persistent potentials from the iliopsoas muscles.

2. In the standing at ease position in the majority of men and women there is no detectable activity in the quadriceps femoris or hamstring muscles. When swaying backwards there was an interval during which there were no potentials from either the anterior or the posterior muscles, and then suddenly there appeared a burst of potentials from the quadriceps femoris. This prevented flexion at the knees which would occur due to gravity.

3. In the standing at ease position there is continuous activity in the calf muscles and no activity in the tibialis anterior. With backward swaying the activity in the calf muscles decreases and that in the tibialis anterior suddenly appears.

Leaning backwards is therefore seen to lessen activity in the posterior spinal muscles (which are responsible for counteracting gravity in 75% of subjects when standing at ease), to increase activity in the abdominal muscles, to initiate activity in the quadriceps femoris, to decrease activity in the calf muscles and to initiate activity in the tibialis anterior.

Although exercises are commonly prescribed to strengthen the back muscles, Nachemson (see Nachemson, A. (1976); A Critical Look at Conservative Treatment for Low Back Pain; Chapter 17 in The Lumbar Spine and Back Pain, edited by Jayson, M. Sector Publishing Ltd., London) does not know of any evidence that subjects with low back pain possess particularly weak back muscles. On the other hand, he says it is known that in certain situations, i.e. when lifting and carrying heavy objects, the increase of intra abdominal and intra thoracic pressure, from contraction of abdominal and costal muscles, will help to relieve some of the load of the lumbar spine. Nachemson therefore regards it as rational that patients who are in a rehabilitation programme after a long period of low back pain should perform isometric abdominal muscle exercises. Also, for these subjects, special reference should be given to the training of the quadriceps muscles, as they take more load when lifting weights the "proper" way than the "wrong" way. When lifting weights, the patient should be instructed to flex the knees and keep the spine as straight as possible, so making use of the knee extensors. Not only are extension exercises unnecessary, but, in addition, many of these exercises increase the load on the lumbar spine to such an extent that it reaches magnitudes as high as those measured in standing and leaning forward with weights in the hands. There is general agreement that such a position should be avoided by back patients. So far as disc pressure is concerned, isometrically performed exercises seem less dangerous.

Helfet and Gruebel Lee (see Helfet, A. J. and Gruebel Lee, D. M. (1978); Disorders of the Lumbar Spine; J. B. Lippincott Company, Philadelphia and Toronto (Chapter 10)) agree with the importance of abdominal strengthening exercises but add that synchronised respiration plays an important part in these. When the patient contracts the abdominal wall, he or she should couple this with strong voluntary exhalation. Helfet and Gruebel Lee confirm that the quadriceps muscles should be exercised, as they are essential for weight lifting with a straight lumbar spine.

Bachman and Noble (see Bachman, D. C. and Noble, H. B. (1978); Helping the patient with low back pain; Modern Medicine, Volume 46, Number 4, page 34) believe that weakness of abdominal and anterior paraspinal muscles is probably responsible for most back pain. They liken the trunk to a cylinder. If one portion of the cylinder wall (the abdominal muscles) is weak, extra strain is placed on the remainder. This weakness explains lumbosacral strain and may be responsible for lumbar lordosis. They write that "exercise instruction is the most beneficial aspect of physical therapy. It should be initiated when acute symptoms subside. Instruction in body mechanics and specific postural exercises should be prescribed for anyone with a history of low back disorder". Helfet and Gruebel Lee note that a firm anterior wall is essential to sustain intra-abdominal pressure and to prevent exaggerated lordosis and abnormal pelvic tilting.

Kuhns (see Kuhns, J. G. (1962); Diseases of Posture; Clin. Orthop. 25, p 64) quotes portural low back sprain as the commonest type of backache. Pain and disability are found most often in the lumbar region where the movable spine is attached to the relatively fixed pelvis. In all of these, the mechanical condition is the disalignment of the spine, particularly the increased lordosis and the forward inclination of the pelvis with the sprain and irritation of the supporting muscles, the ligaments and interspinal joints. In this situation, kuhns works for good abdominal musculature and alignment of the spine, with decrease in the pelvic angle.

The identical conclusions arrived at by the foregoing experts do have experimental backing. Hume Kendall and Jenkins (see Hume Kendall, P. and Jenkins, J. M. (1968); Exercises for Backache: A Double-Blind Controlled Trial; Physiotherapy, 54, p 154) attempted an objective evaluation of exercises frequently recommended "to strengthen and mobilise the spine". They compared the best known "back extension exercises" with both "mobilising exercises" and a group of exercises that achieve their effect by "isometric contraction of the abdominal muscles". In a double-blind controlled trial involving 47 patients, two stopped treatment because their backache was made worse by the exercises—and they were both in the back extension exercise group. A statistically significantly larger group of patients benefitted from the isometric abdominal muscle exercises than from either of the other two groups or both groups added together. The authors were surprised by the significant superiority of the exercises of the isometric flexion type. These were designed to:

A. Correct abnormal forward pelvic tilting and lumbar lordosis, and

B. Strengthen abdominal and trunk muscles, by:

1. lying on the back with the knees bent and contracting the abdominal and pelvic floor and hip adductor muscles, and
2. standing whilst contracting abdominal and pelvic floor and hip-adductor muscles.

These exercises were repeated 12 times, 3 times a day and the standing position exercises were repeated as often as possible during the day.

Helfet and Gruebel Lee remind us that the teaching of correct posture attitudes usually begins with placement of the head in its proper relationship to the trunk. The reverse should be true, since the feet are the base upon which true posture is built, stage by stage. Williams (see Williams, P. C. (1974); Low Back and Neck Pain: Causes and Conservative Treatment; Charles C. Thomas, Springfield, Ill., U.S.A.) believes that the fatigue after standing occurs primarily in the muscles of the low back, for these are the muscles that have been supporting most of the body weight. In the process of relaxing these muscles, the body weight is usually shifted backwards, a shift which decreases the pressure on the front and increases the pressure on the back of the lower lumbar vertebra. Williams advocates that the body weight should be supported primarily on the heels, and the chest should be shifted slightly forward so a crease if formed across the upper abdomen. One or both knees should be slightly bent or flexed. He continues "a shoe in which the sole is higher than the heel would actually be the ideal footwear in the erect position in that it would throw the weight of the body on the heels and make it necessary to bend the trunk slightly forward in order to maintain the centre of gravity. This would relieve pressure from the back edges of the vertebral structures which lie behind in the low back". Merely leaning forward with the knees straight does not alleviate back problems in the same way because the low back muscles have to be firmly contracted in a bowstring action in order to prevent the trunk's being pulled downward by gravity. In such a position the low spine is bent backward and the forward bending of the trunk is taking place at the hip joints.

Whether one believes low back pain to be caused by sprain of the soft, supporting tissues of the back (like Kuhns) or by disc degenerative changes causing narrowing of the neural foramina exacerbated by the lumbar lordosis (like Williams), strengthening of the abdominal musculature with isometric exercises and strengthening of the quadriceps muscles form major parts of postural correction programmes and rehabilitation schedules for low back pain sufferers. Williams goes on to advocate the wearing of a shoe which necessitates a slightly forward bend of the trunk in order to maintain the centre of gravity within a base formed by the margins of the feet. Such a shoe has been manufactured and is known as a "negative-heel" shoe, and is claimed to help low back pain sufferers.

Although various forms of treatment have been shown to be of benefit in acute exacerbations of low-back pain (for example spinal manipulation (see Evans, D. P. et al (1978); Lumbar Spinal Manipulation on Trial Part 1— Clinical Assessment; Rheum. and Rehab.; 17, p 46)) correction of posture and exercises are the only long-term modalities that are likely to prolong relief until spontaneous remission supercedes treatment in late "middle age". Most experts agree that exercise programmes should consist largely of strengthening exercises to the abdominal muscles and to the quadriceps femoris. Abdominal exercises should be performed isometrically.

It is of interest that man is the only biped to attempt balance on such a small base. Kangaroos use their tail so that their centre of gravity falls within the triangle formed by the two legs and the tail. Birds have a projecting tail with which they counterbalance the forward part of their body, this balance being intricately maintained during walking. All other anthropoids stand with slightly flexed knees and hips. Two groups of bipeds, birds and bipedal dinosaurs, had feet with a backward projecting toe. Even in the evolution of man, Proconsul had a well-developed calcaneal basal tubercle projecting backwards so that it could balance in an upright posture more effectively than do modern apes (see Davis, P. R. (1968); On Being Upright in A Companion to Medical Studies, Volume 1; Blackwell Scientific Publications, Oxford and Edinburgh, Chapter 46).

THE INVENTION

It is an object of this invention to provide an improved article of footwear for use, in particular, in the prevention or treatment of low back pain.

To achieve this object there is provided an article of footwear as hereinbefore defined, including:

a ground-engaging sole and an upper part carried by the sole, an integral portion of which sole is projection which extends backwards at least one inch behind the coronal plane containing the posterior aspect of the heel of the wearer when the article is worn by a wearer for whom the size of the article is adapted.

Preferably, the rearward extent is in the range from two to three inches.

The invention will now be described by way of example with reference to the single FIGURE of the accompanying drawing, which is a side view of a shoe in accordance with one example of the invention.

Referring to the FIGURE, a shoe 1 is provided with a sole 2 having a backward projection 3. This backward projection 3 projects backwards for two and one half inches behind coronal plane 4 containing the posterior aspect of the wearer's heel and forms an integral part of the sole 2.

With increasing degrees of backwards lean of a person wearing such a shoe, the vertical, coronal plane containing the centre of gravity of that person moves backwards also. At the point at which this plane passes behind the posterior point of contact of the shoe with the ground, the person tips over backwards. Thus, the shoe, provided with a backward projection, enables a wearer to lean backwards beyond the angle at which he or she would tip over if wearing an ordinary shoe.

Two conflicting considerations determine the design of such a shoe. Firstly, the backward projection should be as small as possible to facilitate normal turning without crossing the projection of the other shoe of the wearer. Secondly, the backward projection must be long enough to ensure that the coronal plane containing the centre of gravity of the body does not fall behind the posterior point of contact of the shoe with the ground. The preferred length is two inches for the backward projection of such a shoe of English size 6 or smaller, and two and one half inches for a larger shoe. In practice, the backward projection should be at least one inch long and usually in the range from two to three inches.

For medical reasons, the backward projection of the heel should be of the same thickness as the sole and the shoe upper should be sufficient to take strain during backwards leaning.

It is intended that such shoes should be worn by postural low back pain sufferers or potential sufferers during periods when they are subject to prolonged standing. At intervals (of at least five minutes in every hour) the wearer should lean backwards with the knees slightly flexed and couple this with strong, voluntary exhalation. This action activates and exercises the abdominal muscles and relaxes the posterior spinal muscles.

Normal walking may be affected surprisingly little by the wearing of such shoes. During walking, the heel normally strikes the ground first, but the effect of the heel-extension is easily overcome. When wearing the extended-heel shoes, leaning backwards from the standing at ease position activates the quadriceps femoris, the tibialis anterior and the abdominal muscles. With prolonged leaning the quadriceps become fatigued initially followed by fatigue in the abdominal muscles. Leaning backwards with the knees slightly bent increases the fatigue experienced in the abdominal muscles and they become fatigued at the same time as the quadriceps.

Instead of being a shoe, an article of footwear according to the invention could be a sandal an integral part of the sole of which is a projection which extends backwards at least one inch behind the coronal plane containing the posterior aspect of the heel of the wearer when the article is worn by a wearer for whom the size of the article is adapted.

I claim:

1. An article of footwear as hereinbefore defined, including a ground-engaging sole and an upper part carried by the sole which are adapted for the article to be worn by a wearer of a certain shoe size, in which article of footwear, an integral portion of the sole extends backwards at least one inch behind the plane which is the coronal plane containing the posterior aspect of the heel of the wearer when the article is worn by a wearer of the shoe size for which the article is adapted, the article of footwear being such that such a wearer, when wearing it, can lean backwards so that the coronal plane containing the centre of gravity of the wearer is between the coronal plane containing the posterior aspect of the heel of the wearer and the coronal plane containing the posterior point of contact of the said portion with the ground, without the wearer tipping over.

2. An article of footwear as hereinbefore defined, including a ground-engaging sole and an upper part carried by the sole which are adapted for the article to be worn by a wearer of a certain shoe size, in which article of footwear, an integral portion of the sole extends backwards a distance in the range from two to three inches behind the plane which is the coronal plane containing the posterior aspect of the heel of the wearer when the article is worn by a wearer of the shoe size for which the article is adapted, the article of footwear being such that such a wearer, when wearing it, can lean backwards so that the coronal plane containing the centre of gravity of the wearer is between the coronal plane containing the posterior aspect of the heel of the wearer and the coronal plane containing the posterior point of contact of the said portion with the ground, without the wearer tipping over.

* * * * *